US008671839B2

(12) United States Patent
Bunczk et al.

(10) Patent No.: US 8,671,839 B2
(45) Date of Patent: Mar. 18, 2014

(54) PROJECTILE AND MUNITION INCLUDING PROJECTILE

(76) Inventors: Joseph M. Bunczk, Douglassville, PA (US); David Francis Jeffers, North Wales, PA (US); Timothy A. Jeffers, Chester, NJ (US)

( * ) Notice: Subject to any disclaimer, the term of this patent is extended or adjusted under 35 U.S.C. 154(b) by 0 days.

(21) Appl. No.: 13/373,096

(22) Filed: Nov. 4, 2011

(65) Prior Publication Data

US 2013/0112100 A1 May 9, 2013

(51) Int. Cl.
*F42B 15/00* (2006.01)
*F42B 10/30* (2006.01)

(52) U.S. Cl.
USPC ..... 102/374; 102/376; 86/51

(58) Field of Classification Search
USPC ..... 102/374, 376, 380, 381, 490; 86/51
See application file for complete search history.

(56) References Cited

U.S. PATENT DOCUMENTS

| | | | | |
|---|---|---|---|---|
| 2,524,591 | A | 10/1950 | Chandler | |
| 2,941,470 | A | 6/1960 | Jasse | |
| 3,176,615 | A | 4/1965 | DeMatthew | |
| 3,212,402 | A | 10/1965 | Hengel et al. | |
| 3,277,825 | A | 10/1966 | Maillard | |
| 3,323,457 | A | 6/1967 | Biehl et al. | |
| 3,344,711 | A | 10/1967 | Mawhinney et al. | |
| 3,349,708 | A | 10/1967 | Paget | |
| 3,434,419 | A | 3/1969 | Dimond et al. | |
| 3,628,457 | A | 12/1971 | Magnusson et al. | |
| 3,696,749 | A * | 10/1972 | Scanlon | 102/380 |
| 3,698,321 | A * | 10/1972 | Wall | 102/374 |
| 3,720,167 | A | 3/1973 | Mainhardt et al. | |
| 3,750,979 | A | 8/1973 | Nelms et al. | |
| 3,861,310 | A * | 1/1975 | Mertens et al. | 102/380 |
| 3,922,967 | A | 12/1975 | Mertens | |
| 4,023,354 | A | 5/1977 | Vetter et al. | |
| 4,197,800 | A | 4/1980 | Greever et al. | |
| 4,295,425 | A | 10/1981 | Davis | |
| 4,314,510 | A * | 2/1982 | Jeter et al. | 102/523 |
| 4,397,240 | A | 8/1983 | Rottenberg et al. | |
| 4,764,319 | A | 8/1988 | Hightower, Jr. et al. | |
| 4,807,532 | A * | 2/1989 | Andersson et al. | 102/490 |
| 4,915,754 | A | 4/1990 | Hightower, Jr. et al. | |
| 5,505,408 | A | 4/1996 | Speicher et al. | |
| 5,662,290 | A | 9/1997 | Voigt | |
| 5,792,981 | A | 8/1998 | Singer et al. | |
| 5,886,289 | A * | 3/1999 | Nixon et al. | 102/490 |
| 6,213,023 | B1 * | 4/2001 | Gunners | 102/490 |
| 7,823,510 | B1 * | 11/2010 | Hobart et al. | 102/490 |
| 7,947,938 | B2 | 5/2011 | Dryer | |
| 2002/0190155 | A1 | 12/2002 | Lipeles et al. | |
| 2004/0200375 | A1 | 10/2004 | Kautzsch et al. | |
| 2010/0000438 | A1 | 1/2010 | Dryer et al. | |

FOREIGN PATENT DOCUMENTS

| | | | |
|---|---|---|---|
| EP | 0 260 936 | A2 | 3/1988 |
| EP | 0 345 420 | A1 | 12/1989 |
| WO | WO 01/55665 | A1 | 8/2001 |
| WO | WO 2008/112510 | A1 | 9/2008 |

* cited by examiner

*Primary Examiner* — James Bergin
(74) *Attorney, Agent, or Firm* — McGinn IP Law Group, PLLC

(57) ABSTRACT

A projectile (and munition including the projectile) and a method of assembling the same, includes a body having a cavity, a propellant disposed in the cavity and a base including an ignition flash column extending into the cavity containing the propellant and a nozzle formed so as to be openable and closeable.

20 Claims, 6 Drawing Sheets

PROJECTILE AND MUNITION INCLUDING PROJECTILE

BACKGROUND OF THE INVENTION

1. Field of the Invention

The present invention relates to a projectile and a cartridge cased munition including a projectile capable of being fired from all existing standard weapons, which may exceed the current velocities, while maintaining the accuracy, of conventional munitions design limitations.

2. Description of the Related Art

Conventional munitions fired from standard weapons typically rely upon a quantity of propellant within a cartridge casing, the shape of the projectile, and barrel and barrel bore characteristics of the weapon for velocity and accuracy.

Current conventional munitions are limited by maximized muzzle velocities which result in limited range and decreasing velocities once they leave the barrel.

SUMMARY OF THE INVENTION

Whereas conventional munitions rely upon a quantity of propellant within the cartridge casing, the shape of and/or weight the projectile and barrel and/or barrel bore characteristics of the weapon for velocity and accuracy, the present invention includes a system that improves the conventional design of the projectile. The improved projectile may exceed velocities of 6,000 fps (feet per second) in flight, while maintaining stable flight characteristics for accuracy and extended effective range.

In previous attempts at producing rocket-propelled and/or assisted projectiles for use in cartridge cased munitions and in non-cartridge cased munitions, there have been several problems encountered, some of which are listed here: (1) the cartridge case propellant has caused premature or delayed ignition of the propellant in the projectile, (2) the cartridge case propellant has caused fracturing and/or powdering of the propellant in the projectile, (3) the ignition point(s) of the propellant in the projectile was uncontrolled and/or of improper ignition site location(s), (4) the propellant in the projectile was exposed to environmental conditions leading to an irregular burn rate and/or hang fire ignition and/or misfire, (5) munitions were not adaptable to standard weapons systems, and/or (6) the munitions failed to meet expectations for functionality, and/or velocity and/or accuracy.

In view of the foregoing, and other exemplary problems, drawbacks, limitations and disadvantages of the conventional munition systems and prior attempts at rocket-propelled projectiles, an exemplary feature of the present invention includes a system capable of (1) controlled ignition timing of the propellant in the projectile, (2) protecting the propellant in the projectile from fracture and/or powdering, (3) selective and precise ignition point(s) of the propellant in the projectile, (4) protecting of propellant in the projectile from detrimental environmental effects, (5) being fired from conventional weapons systems, and (6) exceeding 6,000 feet per second velocities while maintaining accuracy of the projectile.

An exemplary embodiment of the invention includes a body including a cavity, a propellant disposed in the cavity, a base including an ignition flash column extending into the cavity and a nozzle (e.g., a nozzle and/or tube) formed so as to be openable and closable.

Another exemplary embodiment of the invention includes a munition having a cartridge case including a cartridge case propellant, and a projectile attached to the cartridge case. The projectile includes a body including a cavity, a propellant disposed in the cavity, and a base including an ignition flash column extending into the cavity and a nozzle formed so as to be openable and closable.

Another exemplary embodiment of the invention includes providing a cartridge case including a cartridge case propellant therein, providing a projectile body including a cavity formed within, inserting a propellant into the cavity of the projectile body, attaching a base to the projectile body to form a projectile, the base including an ignition flash column extending into the cavity and nozzle formed so as to be openable and closable, and attaching the projectile to the cartridge case.

BRIEF DESCRIPTION OF THE DRAWINGS

The foregoing and other exemplary purposes, aspects and advantages will be better understood from the following detailed description of exemplary embodiments of the invention with reference to the drawings, in which.

DETAILED DESCRIPTION OF EXEMPLARY EMBODIMENTS OF THE INVENTION

Figure 1:
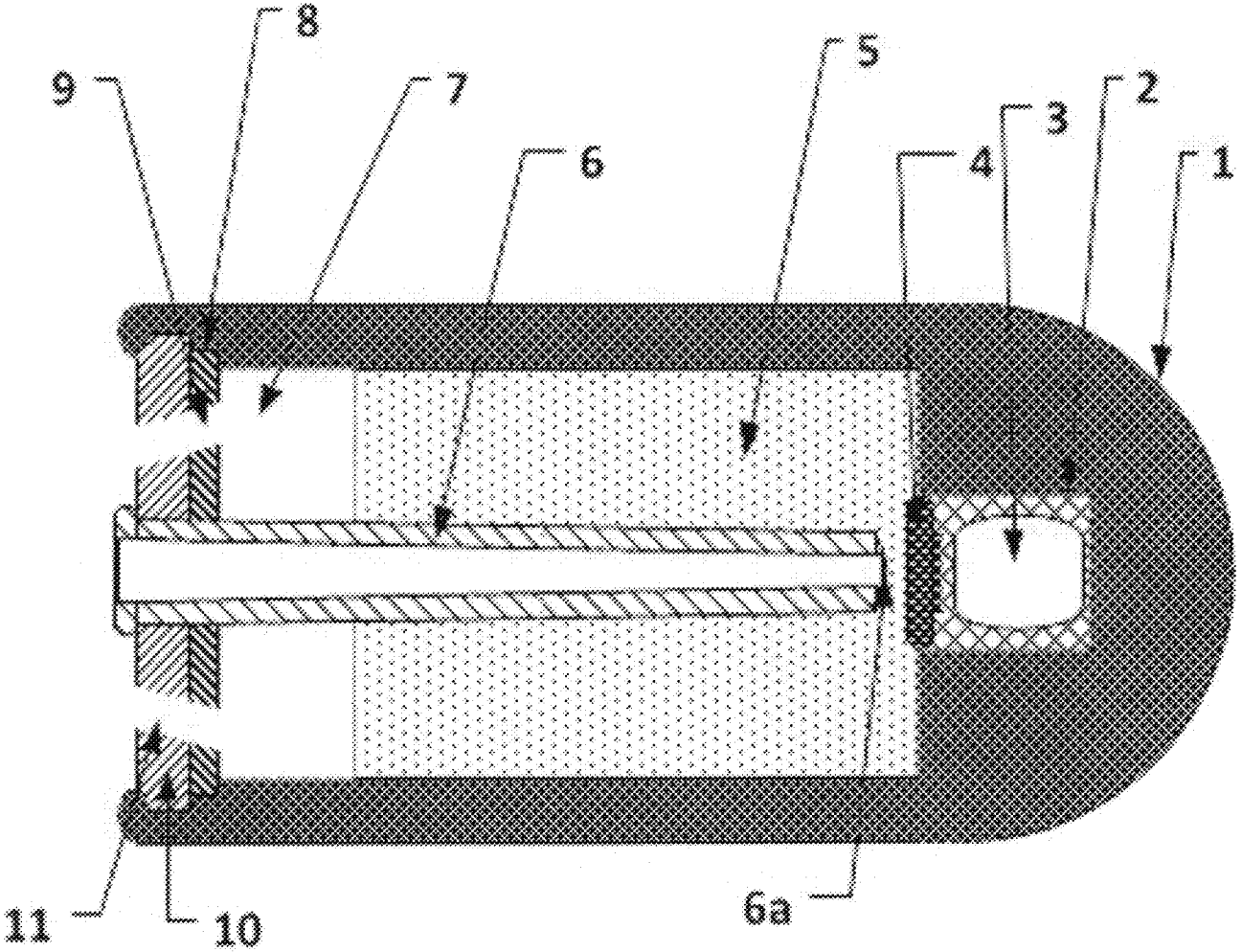
FIG. 1 illustrates an exemplary projectile 1 of the invention.

Referring now to the drawings, and more particularly to FIGS. 1-6, there are shown exemplary embodiments and structures according to the present invention (an exemplary embodiment will now be described).

Referring to FIG. 1, an exemplary embodiment of the present invention includes a propellant cavity 7 formed into the base of the projectile 1. A volume and shape of the propellant cavity 7 may vary upon the caliber of the projectile 1, the length of the projectile 1 and the desired operating parameter(s) of the munitions 12.

The primary projectile propellant 5 may be contained within the propellant cavity 7. One or more layers of primary projectile propellant 5 may be formed and/or shaped into the propellant cavity 7. An exemplary primary projectile propellant 5 may be a solid, liquid and/or gel propellant placed into the propellant cavity 7. The projectile velocity may be controlled by propellant formulary, propellant formed shape, type of propellant, and/or grade of propellant, and/or propellant particle size, use of varying propellants staged or mixed within the projectile 1, use of accelerants in the payload cavity (or cavities) 2 and/or propellant particle shape. The profile of the primary projectile propellant (or propellants in the case of mixtures or multiple layers) 5, with regards to propellant formulation, thrust rating, gas volume velocity, amount and formed shape will depend upon the desired operational parameter(s) of the munitions 12.

The projectile 1 may include an embedded payload cavity (or cavities) 2 in the projectile forward area (i.e., in the direction of flight) of the propellant cavity 7. The volume and shape of the payload cavity (or cavities) 2 may vary upon the caliber of the projectile 1, the length of the projectile 1 and the desired operating parameter(s) of the munitions 12.

The payload cavity (or cavities) 2 of the projectile 1 provides operational expansion capabilities to the munitions 12. The payload cavity (or cavities) 2 may dramatically increase the lethality of the projectile 1 and may be varied to meet the profile of the target. Varying payloads may be encapsulated within reactive and/or inert vial(s) such as ampule container(s) 3 or added to the payload cavity (or cavities) 2 directly using a cavity coating of inert nature within the payload cavity (or cavities) 2. The ampule container(s) 3 is for the containment of material in gaseous, liquid, gel and/or solid state as well as all interphase states between gaseous, liquid and solid state. Exemplary embodiments of the ampule container(s) 3 may be formed of polymer, glass, metal, metal alloy or other suitable materials depending on the contained composition and the desired operating parameter(s) of the munitions 12.

The invention allows for any combination of ampule container(s) 3 and/or direct material application to the payload cavity (or cavities) 2 so as to provide containment of any individual or combination of oxidizer(s), projectile propellant booster(s), explosive material(s), nuclear material(s) (including composition of), organic and/or inorganic compound(s), chemical(s), and/or raw material(s), and/or biological organism(s) (and related materials).

The payload material(s), compound(s) and/or ampule container(s) 3 may be held in place payload cavity seal(s) 4 which may be reactive and/or inert to heat, pressure and/or force. The material(s) selected for the payload cavity seal(s) 4 may vary and depend upon the contained composition and desired operating parameter(s) of the munitions 12.

In an exemplary embodiment of the invention, oxidizers and/or energetic material(s) are stored in the ampule container(s) 3 in order to produce a "hybrid" projectile propellant. Some oxidizer(s) and/or energetic material(s) are stored in the ampule container(s) 3 so as to maintain chemical stability and shelf life because, if some oxidizers come in contact with metal, and/or other any reactive material, they may change their chemical strength and/or composition and become reduced in structure. Thus, such compounds may be encapsulated within an inert container such as ampule container 3 or in cavity (or cavities) treated with a coating of inert nature within the payload cavity (or cavities) 2.

The shape of the primary projectile propellant 5, within the propellant cavity 7, may allow for the insertion of an ignition flash column 6. The ignition flash column 6 extends upward from a base plate 10 of the projectile 1 toward the nose (or forward section) of the projectile 1. The ignition flash column 6 may include an ignition flash column lower opening which opens outside of the projectile body, a mid-portion projecting into the projectile body and the flash hole(s) **6*a* which opens into the propellant cavity 7. Thus, ignition flash column 6 may provide an opening from the cartridge case 13 to the propellant cavity 7 at precise location(s) of the primary projectile propellant 5**.

The ignition flash column 6 directs the cartridge case charge 14 ignition to targeted area(s) of the primary projectile propellant 5 in the propellant cavity 7 through a flash hole(s) **6*a* in the ignition flash column 6. The ignition flash column 6 may include one or more flash holes 6*a* which may be orientated in varying positions depending on the desired ignition location(s) of the primary projectile propellant 5. The ignition flash column 6 may serve as an intermediate chamber area barrier containing either low to high temperature and/or flame sensitive material between the cartridge case charge 14 and the propellant cavity 7** with the intention to delay.

An exemplary embodiment of the invention may have the base plate 10 include a cut hole 16 (preferably centrally located on the base plate 10) to allow the insertion of the ignition flash column 6. In another embodiment, the ignition flash column 6 may be formed as a piece of the base plate 10. The ignition flash column 6 may be integrally formed with the base plate 10, joined to the base plate 10, or otherwise appropriately provided.

The base plate 10 may be a stationary plate at the base of the projectile 1. Besides anchoring the ignition flash column 6 to the projectile 1, the base plate 10 may have a precision cut opening(s) 11 formed there (e.g., thruster nozzle(s) and/or venturi tube(s) 11). The size, depth and/or shape of the opening(s) 11 may vary depending upon the desired operational parameter(s) of the munitions 12. The base plate 10 may have one or more thruster nozzle(s) and/or venturi tube(s) 11 precision cut into it so as to provide vectored thrust of the primary projectile propellant 5 located inside the propellant cavity 7.

The thruster nozzle(s) and/or venturi tube(s) 11 is precision-cut into the base plate 10 at angles, relative to a plane of rotation of the projectile 1, calibrated to the rotary spin dynamics of the associated projectile caliber and/or future weapon system. The projectile thruster nozzle(s) and/or venturi tube(s) 11 may have an angle of 0 degrees parallel to the projectile 1 axial line of latitude and/or any angle up to and including 90 degrees of the projectile 1 axial length. The thruster nozzle(s) and/or venturi tube(s) 11 may be of the same and/or varied angle(s). The thruster nozzle(s) and/or venturi tube(s) 11 may be located either of equal and/or varied distance(s) between/amongst each and equally and/or variably radially located within the circumference of the projectile 1 base plate 10.

The thruster nozzle(s) and/or venturi tube(s) 11 directs the expanding gases of the primary projectile propellant 5 within the propellant cavity 7 to create the thrust, the forward propulsion and stabilized radial spin of the projectile 1 in flight.

Forward of the base plate 10 (toward the nose, or forward section, of the projectile 1), is the rotary indexing disk 8. The rotary indexing disk 8 may have a centrally located opening 19 that allows for the insertion of the ignition flash column 6 through it. The rotary indexing disk 8 may have free course to rotate around the central axis of the ignition flash column 6. The rotary indexing disk 8 may or may not sit in a stepped relief or groove (e.g., a raceway platform for the rotary indexing disk 8) cut into the projectile 1. This stepped relief or groove is precision-cut and allows for the free rotation of the rotary indexing disk 8. This stepped relief or groove serves the purpose of holding the rotary indexing disk 8 in place while enabling the rotary indexing disk 8 to rotate about the ignition flash column 6.

The rotary indexing disk 8 may have precision cut opening(s) 9 in the disk that align with the thruster nozzle(s) and/or venturi tube(s) 11 of the base plate 10. The size, depth and/or shape of the opening(s) 9 may vary dependent upon the desired operational parameter(s) of the munitions 12. The rotary indexing disk 8 may be rotatable in a circumferential direction in relationship to the base plate 10 so as to align the opening(s) 9 in the rotary indexing disk 8 with the thruster nozzle(s) and/or venturi tube(s) 11 revealing an "Open" position of the propellant cavity 7 to the outside of the projectile 1 and conversely, a "Closed" position creating a barrier between the propellant cavity 7 and the outside of the projectile 1. The projectile base plate 10 and rotary indexing disk 8 may separate and maintain the integrity of projectile cavity propellant from cartridge case propellant pressure curve and cartridge case propellant flame volume (in the closed position). The rotary indexing disk 8 may achieve all percentages of coverage of the base plate's thruster nozzle(s) and/or venturi tube(s) 11 from fully open to fully closed. Thus, the projectile thruster nozzle(s) and/or venturi tube(s) 11 orifice may be regulated from a closed orifice position to complete open orifice position with all degrees of orifice opening between the closed to fully open position.

Figure 3:
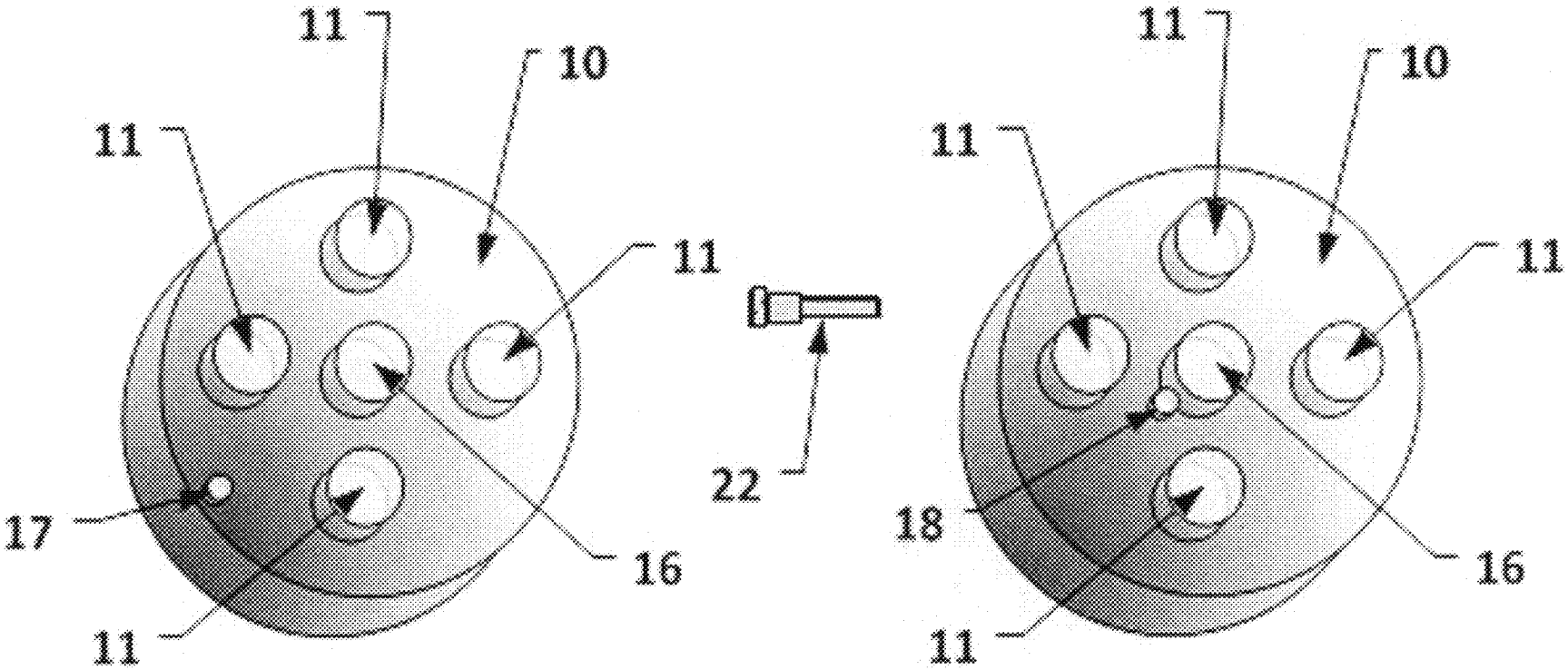
FIG. 3 illustrates exemplary views of the base plate 10 of the invention.
Figure 4:
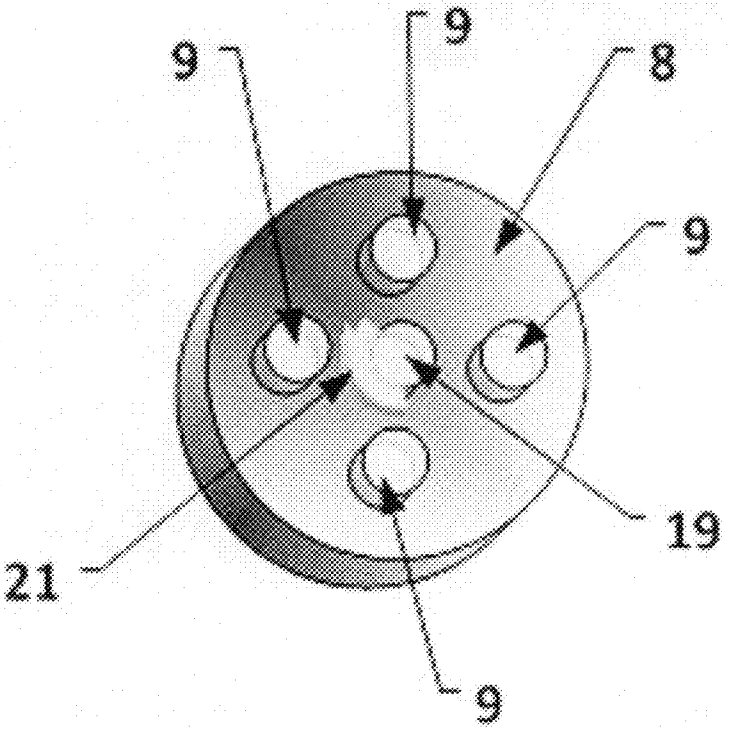
FIG. 4 illustrates exemplary rotary indexing disks 8 of the invention.
Figure 4:
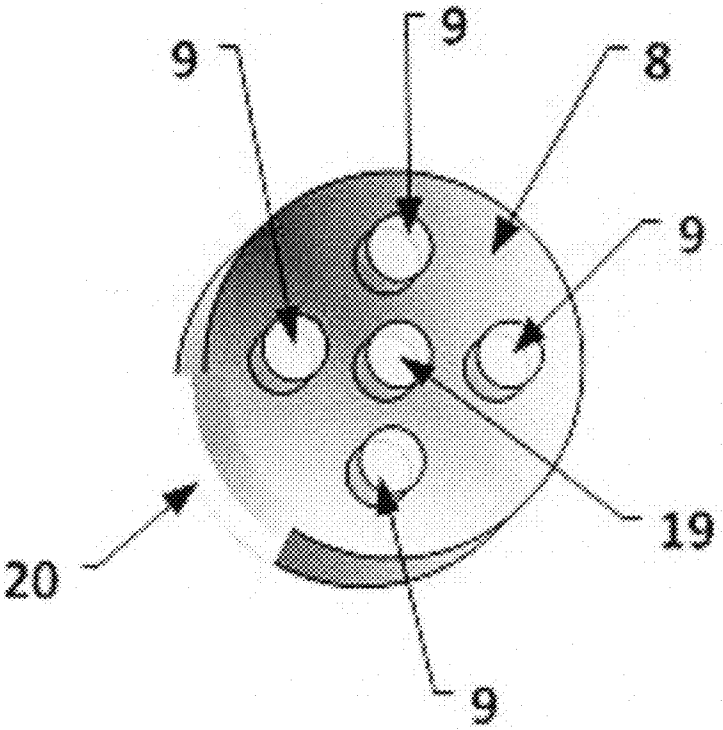

In an exemplary embodiment, as illustrated in FIGS. 3 and 4, the rotary indexing disk 8 may be formed with a radial arc relief 20 cut into a side/circumference/periphery for use in conjunction with a base plate 10 with a fixed register member (e.g., pin) 22 inserted into a fitted hole 17 through the base plate 10. This embodiment allows the rotary indexing disk 8 to rotate from one end of the radial arc relief 20 to the other and all points in between. The radial arc relief 20 may be cut into the rotary indexing disk 8 such that registry of the fixed register member 22 at one end of the radial arc relief 20 creates a closure of the base plate 10 thruster nozzle(s) and/or venturi tube(s) 11 and conversely, the registry of the fixed register member 22 at the opposite end of the radial arc relief 20 creates an opening of the propellant cavity 7 to the external environment via the base plate 10 thruster nozzle(s) and/or venturi tube(s) 11.

Another exemplary embodiment places the radial arc relief 21 on the interior cut away of the rotary indexing disk 8, through which the ignition flash column 6 is inserted. This embodiment of the rotary indexing disk 8 is used in conjunction with a register member 22 inserted into a fitted hole 18 through the base plate 10. This embodiment allows the rotary indexing disk 8 to rotate between "Open" and "Closed" positions at each end of the radial arc relief 21.

The method employed to achieve rotary indexing disk "Open" and "Closed" positions and all fractions of and between open and closed positions will depend upon the projectile 1 caliber, the configuration of the munitions 12 and the desired operational parameter(s) of the munitions 12.

The opening(s) 9 of the rotary indexing disk 8 is initially (i.e. as in a fully assembled round of munition, as a complete round of munition, as a loaded round of munition in storage or prior to activation) in a closed position, with respect to the thruster nozzle(s) and/or venturi tube(s) 11 of the base plate 10, within the cased munition 12. The rotary indexing disk 8 is held in place to ensure the closed position of the rotary indexing disk 8 until firing of the munition 12. Methods employed to hold the rotary indexing disk 8 in place may vary.

An exemplary method of holding the rotary indexing disk 8 in a closed position may include a pressure detent in the radial arc relief 20 of the rotary indexing disk 8. The detent may or may not be located close the register member 22 while in the "Closed" position; The detent pressure would be such to release the rotation of the rotary indexing disk 8 after an amount of temperature and/or torque is applied to the rotary indexing disk 8 in the direction of the "Open" position.

Another exemplary embodiment of holding the rotary indexing disk 8 in the "Closed" position is to employ a lacquer coating, resin, multi-component resin, epoxy compound(s) upon the rotary indexing disk 8 and base plate 10, formulated to release under temperature and/or torque. Additionally, the lacquer coating may also act to protect the projectile propellant 5 from environmental factors.

Generally, the method of holding the indexing disk 8 in place may be varied depending on the munition 12 used and other design factors.

In an exemplary embodiment of the invention and as evident from the above, the interworking of the base plate 10 and indexing disk 8 create a multi-position system for the projectile 1, including "Open" and "Closed". In the "Closed" state, the rotary indexing disk 8 and base plate 10 combine to protect against fractionalization and/or powdering of primary projectile propellant 5 in the propellant cavity 7, improper and/or premature ignition of primary projectile propellant 5 in the projectile cavity 7, and to provide targeted and timed ignition of the primary projectile propellant 5 via the ignition flash column 6 and flash hole(s) **6*a*. The "Closed" state also may provide environmental protection of the contents of the propellant cavity 7**.

In the "Open" state, the rotary indexing disk 8 and base plate 10 combine to provide precision directional thrust of the expanding gases from the ignited primary projectile propellant 5, provide calibrated, stabilizing radial spin to the projectile 1, and to provide access to an optional payload cavity (or cavities) 2 for a specified deployment characterization.

Once the projectile 1 separates from the cartridge case 13 and engages the land(s) and groove(s) of a barrel bore of a subject weapon, a centrifugal force of the spinning projectile 1 may cause the rotary indexing disk 8 to rotate. Simultaneously, the flame/flash of the cartridge case charge 14 will travel through the ignition flash column 6, through the flash hole(s) **6*a* and ignite the primary projectile propellant 5. The rotary indexing disk 8 may stop rotating once the openings 9 in the rotary indexing disk 8 fully expose the thruster nozzle(s) and/or venturi tube(s) 11 of the base plate 10. This will facilitate the escape of expanding gases from the ignited primary projectile propellant 5 in the propellant cavity 7, thereby creating thrust. The precision cut angles of the thruster nozzle(s) and/or venturi tube(s) 11 will sustain stable radial spin of the projectile 1** in flight.

Figure 5:
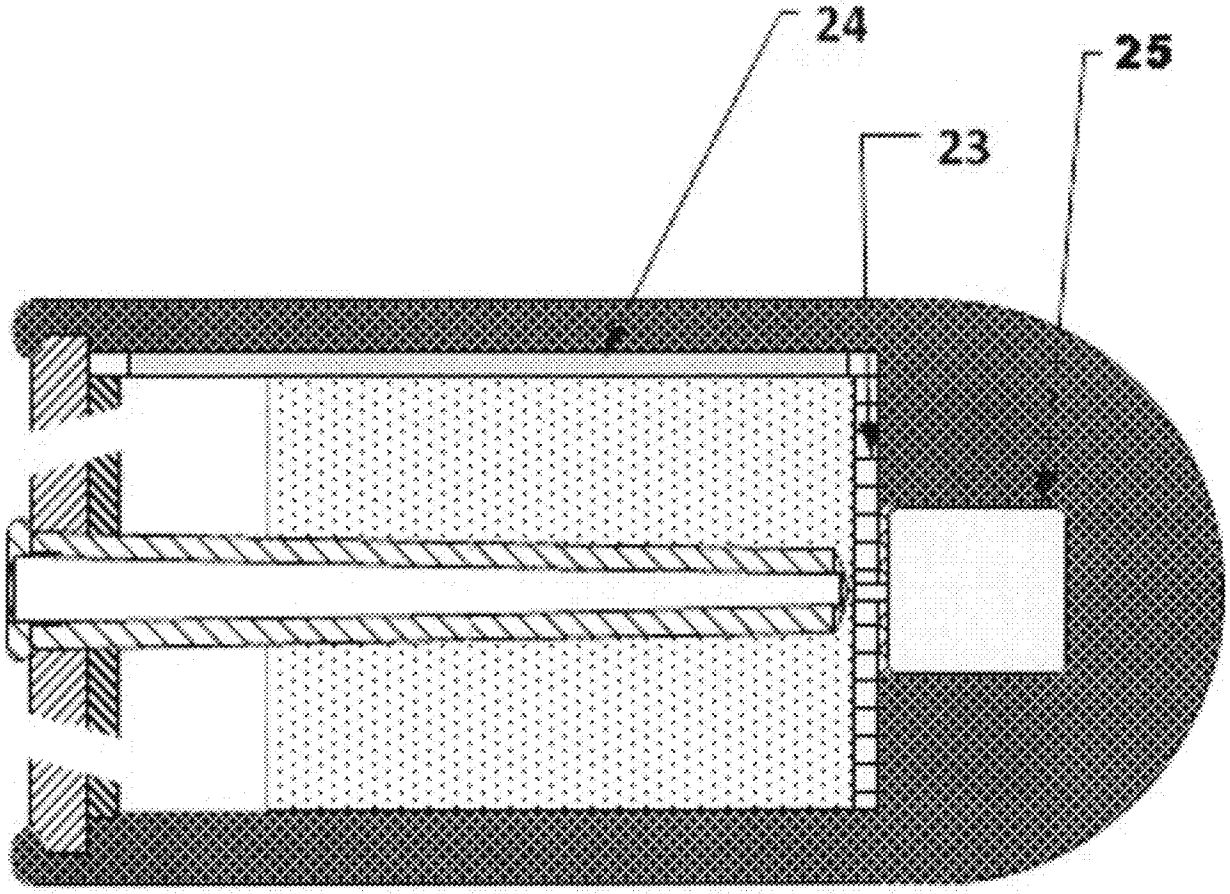
FIG. 5 illustrates an exemplary projectile with motor of the invention.

As illustrated in FIG. 5, another exemplary embodiment integrates a motor-25 and controller to manipulate the position of the rotary indexing disk's opening(s) 9 relative to the base plate thruster nozzle(s) and/or venturi tube(s) 11. Motor 25, which may be a servo motor or magnetic drive, includes a controller to manipulate the position of the rotary indexing disk opening(s) 9 through the use of a takeoff gear 23 engaged with a spline gear on a drive shaft 24, which in turn engages with the rotary indexing disk 8. The projectile 1 may optionally include a sensor connected to the controller.

Rotary adjustment of the rotary indexing disk 8 may cause a change in thruster nozzle(s) and/or venturi tube(s) 11 opening diameter, volume and elliptical gas flow of one or more thruster nozzle(s) and/or venturi tube(s) 11 causing controlled roll, yaw and pitch for controlled projectile flight. By changing a position of the rotary indexing disk 8, an angle of gas flow and thrust, and amount of expanding gases can be controlled in flight. The variation of the angle of gas flow and thrust, and opening for gases will vary the flight characteristics of the projectile 1 mid-flight. This may be accomplished by varying the position of rotary indexing disk 8 so as to control the degree in which the base plate 10 thruster nozzle(s) and/or venturi tube(s) 11 is exposed.

The length of the projectile 1 may vary thus providing greater volume for Propellant cavity 7 and/or payload cavity (or cavities) 2. The length of the projectile 1 will depend upon the physical characteristics of the cartridge case 13 and the desired operational parameter(s) for the munitions.

The above exemplary, non-limiting, embodiments of the invention have several exemplary aspects and advantages.

The projectile 1 may be controlled by thruster nozzle(s) and/or venturi tube(s) 11 orifice size, and/or number of thruster nozzle(s) and/or venturi tube(s) 11, and/or shape of thruster nozzle(s) and/or venturi tube(s) 11.

The projectile velocity may be controlled by type of primary projectile propellant 5, and/or grade of propellant, and/or formulary of propellant, and/or propellant particle size, and/or propellant particle shape.

The primary projectile propellant 5 may be ignited at any pre-selected area(s) and/or site(s) by means of an ignition flash column 6.

The projectile thruster nozzle(s) and/or venturi tube(s) 11 orifice may be regulated from a closed orifice position to complete open orifice position with all degrees of orifice opening between the closed to full open position.

The base plate 10 and rotary indexing disk 8 may separate and maintain the integrity of primary projectile propellant 5 from cartridge case propellant 14 pressure curve and cartridge case propellant 14 flame volume.

Ignited primary projectile propellant 5 may be exposed to atmosphere by rotation of rotary indexing disk 8 and its pre-set alignment with the base plate 10 thruster nozzle(s) and/or venturi tube(s) 11.

Rotary adjustment of rotary indexing disk 8 may cause a change in thruster nozzle(s) and/or venture tube(s) 11 opening diameter and elliptical gas flow causing yaw, pitch and/or roll for controlled projectile flight.

The projectile 1 delivers a controlled burn and precision thrust. Due to the precise and controlled ignition of the primary projectile propellant 5 and stability of the vectored thrust, varying propellants with higher gas expansion curves can be adopted for use as the primary projectile propellant 5.

Additional advantages of a controlled ignition of the primary projectile propellant 5 may include the use of propellants with higher gas expansion rates (i.e., greater velocities) without detrimental effects on the weapon, the use of primary projectile propellants 5 that can operate in low oxygenated and non-oxygenated environments (i.e., space, undersea and the like) and the ability to use layered and/or mixed propellants for multiple operational characteristics (i.e., multi-stage propellant layering).

Another exemplary embodiment of the invention, herein referred to as the complete munition 12, combines the previously described exemplary embodiment, the projectile 1, with a standard, customized or future cartridge case 13. The length of the projectile 1 will depend upon the physical characteristics of the cartridge case 13 and the operational needs for the munitions 12.

Figure 2:
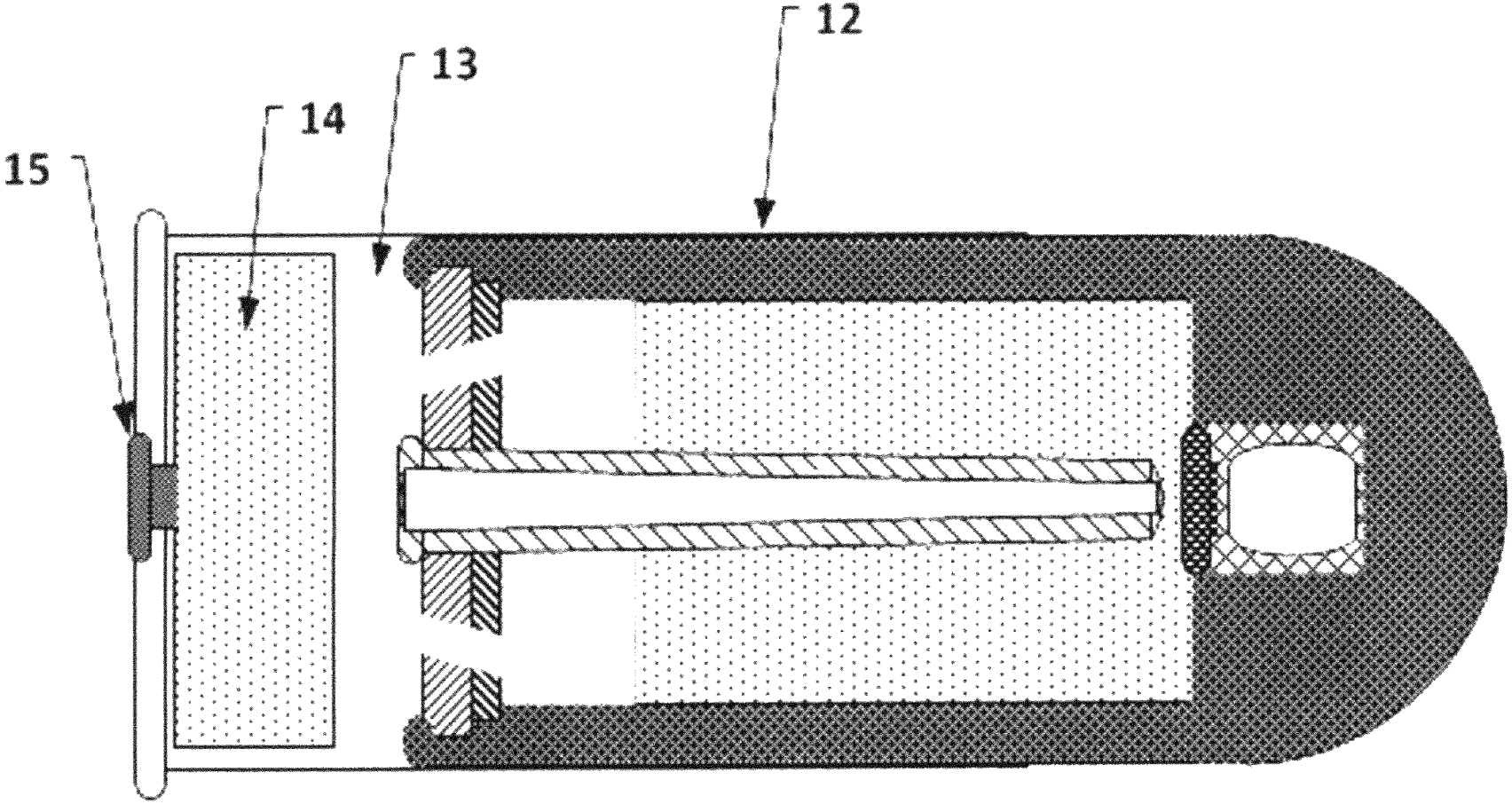
FIG. 2 illustrates an exemplary complete munition 12 of the invention.

Referring to FIG. 2, an exemplary embodiment of the present invention, referred to as the complete munition 12, may have the outward appearance of a standard munition. An exemplary munition 12 of the invention may include a cartridge case 13 and the projectile 1. The munition may be constructed to standardized dimensions of an existing munition and is designed to be used as a primary and/or a secondary munition in existing weapons platforms. The present invention can be applied to all munitions calibers.

Alternatively, the munition can be constructed, in all calibers, in modified length and cartridge case diameter dimensions for new and/or miniaturized weapons platforms.

An exemplary embodiment of the present invention includes cartridge case propellant 14 inside the cartridge case 13. The amount of cartridge case propellant 14 may vary. Exemplary amounts of the cartridge case propellant 14 may range from reduced quantities to standard quantities of existing munitions and is dependent upon the desired operating parameter(s) of the munitions 12. Cartridge case propellant 14 may be ignited by primer charge 15, or any form of electrical, chemical or mechanical ignition.

There are several advantages associated with using the above described exemplary cased munition system (the complete munition 12).

By keeping the cartridge cased design, the complete munition 12 realizes the benefits of a closed system. A closed system may provide climate and/or environment protection of all munitions 12 internal parts including, the cartridge case propellant 14, the primer charge 15, and the propellant cavity 7 of the projectile 1.

In addition, the complete munition 12 allows the same fit and function in existing weapons systems. Exemplary embodiments of the complete munition 12 do not alter the physical appearance or exterior dimension of past or current commercial and military munitions. Therefore, the complete munition 12 may be used in all current and past weapons. The complete munition 12 can be used in small arms (handgun and long gun), intermediate-size weapons, and light and large artillery.

An exemplary embodiment of the invention may deliver standard functionality with a reduced cartridge case propellant 14 requirement so that the munition 12 may operate with reduced barrel chamber pressures within the weapon during firing of the munition 12.

Some advantages of the reduced barrel chamber pressures include that the munition cartridge case 13 may be constructed with polymer, polymer/metal alloy(s) metal alloy(s), polymer resins and/or composite materials for reduced cost and weight. All currently used materials of brass, copper, nickel plate (brass) and steel can also be supported by the invention.

Further, the reduced chamber barrel pressure can produce reduced foot pounds of recoil, delivering less stress to the platform and providing more stable weapons systems. This additionally reduces the stress on weapons systems, thereby reducing maintenance requirements.

In addition, the reduced chamber barrel pressures may reduce the stress on the primary projectile propellant 5 in the propellant cavity 7 of the projectile 1.

Reduced chamber barrel pressures may reduce the discharge report (signature) of the munition, thereby increasing stealth.

The complete munition 12, with lower barrel chamber pressure, may allow weapons and/or weapon components to be constructed or retrofitted with lightweight materials such as non-ferrous and/or polymer resin material.

The complete munition 12 maintains the integrity of the projectile propellant 5 as not to fracture or powder under initial and continued thrust and torque forces generated from internal and external ballistics.

The complete munition 12 maintains primary projectile propellant 5 integrity so that reliable ignition and flight stability are ensured.

Exemplary embodiments of the complete munition 12 may deliver projectile velocities in excess of 6,000 feet per second in flight, which may result in a flat trajectory, decreased weapon projectile to target flight time, increased weapons to target engagement distance, and minimizing aiming error on moving and/or maneuvering targets. Additionally, at these velocities, weapon systems and/or platforms can penetrate and/or defeat armor-proof, armor protective-covered systems, and/or land, sea, air, vehicle and/or structures.

Due at least in part to the primary projectile propellant 5, the complete munition 12 may use a fraction of the cartridge case propellant 14 when compared to conventional equivalent caliber munitions.

The complete munition 12 may be used in land atmosphere, aqueous atmosphere, vacuum atmosphere, and zero-gravity atmospheres.

The complete munition 12 may include a multi stage propellant system with each stage independent of the other.

The complete munition 12 may be used in all rifled barrel bore technologies of current and/or previous rifled barrel bores. Examples include, but are not limited to broach cut, button cut, hammer forged mandrel, polygonal, hexagonal, octagonal, rifled choke tube, and etc.

The complete munition 12 may allow for use in barrel bore left-hand twist rifling and barrel bore right-hand twist rifling. Indeed, the projectile's rotary indexing disk 8 design permits projectile use and operation of any same caliber munitions, in either left hand twist rifled bore or right hand twist rifled bore.

The complete munition 12 may operate in a rifled barrel bore including a single land and/or a single groove and a rifled barrel bore of any multiple lands and grooves. The complete munition 12 may operate in a rifled barrel bore, a smooth barrel bore (devoid of rifling), and an interrupted smooth-rifled barrel bore.

The complete munition 12 may be constructed with or without the projectile 1 having an outer sheath and/or sabot housing either of smooth construction and/or of a veined contour so as to induce rotational spin on the projectile 1.

Figure 6:
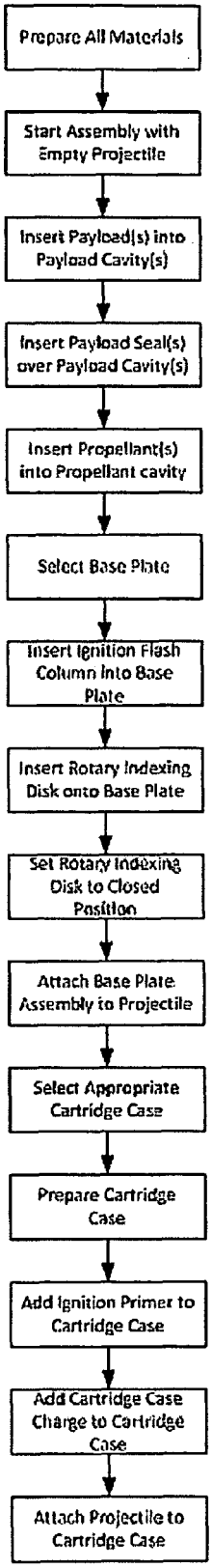
FIG. 6 illustrates a flowchart of an exemplary method of assembly.

As illustrated in FIG. 6, another exemplary embodiment of the invention, herein referred to as munition assembly, describes the assembly of the previously detailed exemplary embodiments, the projectile 1 and the complete munition 12.

Each element of the projectile 1 and/or the complete munition 12 may be assembled individually according to performance requirements or operational needs. The payload cavity (or cavities) 2 may be assembled and fitted with various combinations of propellant accelerants, propellants, nuclear, chemical and/or biological payloads. The propellant cavity 7 may be outfitted with solid, semi-solid, liquid and/or gaseous compound. The base plate 10, including the rotary indexing disk 8 and ignition flash column 6 may be attached to the projectile 1 to complete its assembly. A pre-primed cartridge case 13 may be charged with cartridge case propellant 14 or a fired cartridge case 13 may be de-capped (removal of used primer) and a live primer 15 may be inserted into the cartridge case 13 base. Once the cartridge case 13 is ready, the projectile 1 may be seated and crimped to the cartridge case 13 in standard manner to finish the complete munition 12.

Each of the steps described above may be individually performed and/or combined with pre-fabricated variants of two or more components to aide in the speed of assembly and/or simplify the storage of components.

In an exemplary embodiment of this invention, the primary projectile propellant 5 in the projectile cavity 7 may be formed and/or pre-shaped for insertion, to allow for free access to the payload cavity (or cavities) 2 for insertion of a sealed ampule container(s) 3 and/or other desired material(s) directly into the payload cavity (or cavities) 2 or may be inserted after the insertion of the sealed ampule container(s) 3 in the payload cavity (or cavities) 2.

In this exemplary embodiment, the munitions 12 can be pre-loaded with varying payloads and/or in field implementations. For field implementations, munitions 12 can be issued (as components) with empty payload cavity (or cavities) 2, and separate base plates 10 with primary projectile propellant 5 intact. Payload cavity (or cavities) 2 then can be loaded with desired materials for changing operational needs, the payload cavity seal 4 can be secured and the base plate 10 then can be joined to the projectile 1. After crimping to the cartridge case 13 with cartridge case propellant 14, the complete munition 12 is ready for deployment.

The above assembly method is not intended to be comprehensive, nor exhaustive, it is merely intended to provide a sample guideline to the steps involved in assembly for a single use/embodiment.

While the invention has been described in terms of exemplary embodiments, those skilled in the art will recognize that the invention can be practiced with modification within the spirit and scope of the appended claims.

Further, it is noted that, Applicants' intent is to encompass equivalents of all claim elements, even if amended later during prosecution.

The invention claimed is:

1. A projectile comprising:

a body including a cavity;

a propellant disposed in the cavity; and a base including;

an ignition flash column extending into the cavity and a nozzle formed so as to be openable and closable;

a base plate attached to the body including the nozzle; and a rotary, indexing disk including an opening, rotatable in a circumferential direction in relationship to the base plate so as to open and close the nozzle of the base plate, respectively.

2. The projectile according to claim 1, wherein the ignition flash column includes a flash hole disposed inside the cavity and a flash column opening which communicates with an outside of the projectile.

3. The projectile according to claim 1, wherein the rotary indexing disk respectively aligns the rotary indexing disk opening of the rotary indexing disk with the base plate nozzle so as to open the nozzle of the base plate and covers the base plate nozzle with a solid area of the rotary indexing disk so as to close the nozzle of the base plate.

4. The projectile according to claim l, wherein the nozzle comprises a plurality of nozzles and the opening comprises a plurality of openings.

5. The projectile according to claim 1, wherein at least one of the rotary indexing disk and the base plate includes a registration member and at least one of the base plate, the rotary indexing disk and the body includes a registration member accepting portion disposed such that the registration member is accommodated within the registration member accepting portion so as to control a range of rotation of the rotary indexing disk.

6. The projectile according to claim 5, wherein the registration member is positioned such that, if the registration member is disposed at a circumferential end of the registration member accepting portion, then the nozzle is open.

7. The projectile according to claim 5, wherein the registration member is positioned such that, if the registration member is disposed at a circumferential end of the registration member accepting portion, then the nozzle is closed.

8. The projectile according to claim 1, further comprising a holding member which is formed so as to prevent rotation of the rotary indexing disk until at least one of a predetermined torque and a temperature is achieved.

9. The projectile according to claim 1, wherein the base is formed such that the nozzle is openable by a rotational force of the projectile.

10. The projectile according to claim 1, wherein the rotary indexing disk is formed such that the rotary indexing disk is rotatable by a centrifugal force relative to the base plate.

11. The projectile according to claim 1, wherein the body further includes a payload cavity configured so as to be openable and closable to the cavity.

12. The projectile according to claim 11, wherein at least one of an oxidizer, a projectile propellant booster, an explosive material, a nuclear material or composition thereof, an organic compound, an inorganic compound, a chemical, a raw material, and a biological organism is disposed in the payload cavity.

13. The projectile according to claim 11, wherein a sealed ampule or an inert container is disposed in the payload cavity.

14. The projectile according to claim 1, wherein the nozzle comprises an opening angled such that, if a propellant gas volume is ejected from the nozzle, then a spinning force is imparted to the projectile or is maintained by the projectile.

15. The projectile according to claim 1, further comprising:

a motor disposed in the projectile; and a driveshaft connecting the motor to the rotary indexing disk such that the motor controls an opening and closing of the nozzle.

16. The projectile according to claim 1, wherein the nozzle comprises a plurality of nozzles.

17. A munition, comprising:

a cartridge case including a cartridge case propellant and an ignition system; and a projectile attached to the cartridge case, the projectile comprising:

a body including a cavity;

a propellant disposed in the cavity; and a base including;

an ignition flash column extending into the cavity and a nozzle formed so as to be openable and closable;

a base plate attached to the body including the nozzle; and a rotary indexing disk including an opening, rotatable in a circumferential direction in relationship to the base plate so as to open and close the nozzle of the base plate, respectively.

18. The munition according to claim 17, wherein the nozzle comprises a plurality of nozzles.

19. A method of assembling a munition, comprising:

providing a cartridge case including a cartridge case propellant and an ignition system therein;

providing a projectile body including a cavity formed within;

inserting a propellant into the cavity of the projectile body;

attaching a base to the projectile body to form a projectile, the base including an ignition flash column extending into the cavity and nozzle formed so as to be openable and closable, a base plate attached to the body including the nozzle, and a rotary indexing disk including an opening, rotatable in a circumferential direction in relationship to the base plate so as to open and close the nozzle of the base plate, respectively; and attaching the projectile to the cartridge case.

20. A method of assembling a munition according to claim 19, wherein the body includes a payload cavity, and wherein a material is inserted into the payload cavity prior to propellant insertion and attaching the base to the body.

* * * * *